US006543822B1

(12) United States Patent
King et al.

(10) Patent No.: US 6,543,822 B1
(45) Date of Patent: Apr. 8, 2003

(54) SELF-PRESENTING SECONDARY HOOD LATCH ASSEMBLY

(75) Inventors: Patrick J. King, Gaylord, MI (US); Garrett J. Wize, Sterling Heights, MI (US); William R. Gentile, Pontiac, MI (US); Jason A. Beauchamp, Pellston, MI (US); Richard M. Leatzau, Clarkston, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 90 days.

(21) Appl. No.: 09/659,612

(22) Filed: Sep. 11, 2000

(51) Int. Cl.[7] ..... E05C 3/06
(52) U.S. Cl. ..... 292/214; 292/DIG. 14
(58) Field of Search ..... 292/216, 126, 292/DIG. 14, 214

(56) References Cited

U.S. PATENT DOCUMENTS

| | | | | | |
|---|---|---|---|---|---|
| 1,097,155 | A | * | 5/1914 | Adams | 292/126 |
| 1,874,230 | A | * | 8/1932 | Blackmore | 292/113 |
| 2,028,954 | A | * | 1/1936 | Roedding | 292/126 |
| 2,237,232 | A | * | 4/1941 | Kiesling | 292/126 |
| 2,476,062 | A | * | 7/1949 | Pierce | 70/298 |
| 3,117,731 | A | * | 1/1964 | Rackley | 240/147 |
| 4,382,482 | A | * | 5/1983 | Brandl | 180/69 R |
| 4,456,289 | A | | 6/1984 | Badiali | |
| 4,530,412 | A | | 7/1985 | Sigety | |
| 4,756,562 | A | | 7/1988 | Foster | |
| 4,896,907 | A | | 1/1990 | Hayakawa | |
| 4,917,417 | A | | 4/1990 | Aubry | |
| 4,917,420 | A | | 4/1990 | Rogers | |
| 4,961,601 | A | | 10/1990 | Lindholm | |
| 5,046,768 | A | | 9/1991 | Myslicki | |
| 5,048,877 | A | | 9/1991 | Rogers | |
| 5,118,146 | A | | 6/1992 | Watanuki | |
| 5,306,053 | A | | 4/1994 | Garusami | |
| 5,445,421 | A | | 8/1995 | Ferrara | |
| 5,618,069 | A | | 4/1997 | Konchan | |
| 5,682,667 | A | | 11/1997 | Flagg | |
| 5,738,393 | A | * | 4/1998 | Chao | 292/216 |

* cited by examiner

*Primary Examiner*—Gary Estremsky
(74) *Attorney, Agent, or Firm*—Casimer R. Kiczek

(57) ABSTRACT

A secondary latch assembly includes a mounting bracket, a release hook pivotally mounted to the mounting bracket, and a handle mechanism pivotally mounted to the mounting bracket. The release hook is movable between a locked position and a released position and has a slot having a first end and a second end. The handle mechanism has a rotation stop that is positioned within the slot of the release hook and that is movable between the first and second ends of the slot. The handle mechanism is movable between a first position where the rotation stop is positioned at the first end of the slot, a second position where the rotation stop is positioned at the second end of the slot, and a third position wherein the handle mechanism is rotated from its second position while the rotation stop is positioned at the second end of the slot so that the rotation stop urges the release hook from its locked position to its released position.

24 Claims, 12 Drawing Sheets

SELF-PRESENTING SECONDARY HOOD LATCH ASSEMBLY

FIELD OF THE INVENTION

The present invention generally relates to a latch assembly and, more particularly, to a self-presenting secondary latch assembly for maintaining a hood of a motor vehicle or other hinged panel in a partially opened position.

BACKGROUND OF THE INVENTION

Vehicle hoods are typically provided with a primary latch and a secondary or safety latch. Hoods on such vehicles are biased upwardly when the primary latch is released and are latched by the secondary latch in a partially opened position when a striker member engages the secondary latch. Releasing the secondary latch allows the hood to enter a fully opened position.

It is known to provide a handle under the hood for releasing the secondary latch to allow the hood to enter a fully opened position. The position of such handles varies from vehicle type to vehicle type, and it is difficult for a person to anticipate the position of such a handle on a vehicle type the person is unfamiliar with. It is also known to have a secondary hood latch that has a release handle that is presented when the primary latch is released. Such secondary latches are mounted on a stationary portion of the vehicle within the interior of the vehicle's engine area, thus taking up space within the engine area and increasing the time and cost of installation.

One proposed solution to the above problems is described in U.S. Pat. No. 4,756,562 to Foster et al. However, the complexity of the secondary hood latch described therein makes the secondary hood latch relatively expensive and time consuming to manufacture and assemble.

Accordingly, there is a need in the art for a self-presenting secondary latch assembly which is compact, which is mountable to the hood of a vehicle as a whole assembly so that installation is simplified and space is saved, and which utilizes few parts so that manufacture is simplified and production costs are decreased.

SUMMARY OF THE INVENTION

The present invention provides a secondary latch assembly which overcomes at least some of the above-noted problems of the related art. According to the present invention, a secondary latch assembly comprises, in combination, a mounting bracket, a release hook pivotally mounted to the mounting bracket, and a handle mechanism pivotally mounted to the mounting bracket. The release hook is movable between a locked position and a released position and has a slot having a first end and a second end. The handle mechanism has a rotation stop that is positioned within the slot of the release hook and that is movable between the first and second ends of the slot. The handle mechanism is movable between a first position where the rotation stop is positioned at the first end of the slot, a second position where the rotation stop is positioned at the second end of the slot, and a third position wherein the handle mechanism is rotated from its second position while the rotation stop is positioned at the second end of the slot so that the rotation stop urges the release hook from its locked position to its released position.

The secondary latch assembly may include biasing means for biasing the release hook in the locked position and may also include biasing means for biasing the handle mechanism in the second position. In one preferred embodiment, the handle mechanism comprises a release handle pivotally mounted to the mounting bracket and a striker plate connected to the release handle. In a second preferred embodiment, the handle mechanism comprises a striker plate pivotally mounted to the mounting bracket, a release handle pivotally mounted to the mounting bracket remote from the striker plate, and a connector mechanism operatively interconnecting the striker plate and the release handle.

According to another aspect of the present invention, a secondary latch assembly comprises, in combination, a mounting bracket, a release hook pivotally mounted to the mounting bracket about an axis, and a handle mechanism pivotally mounted to the mounting bracket. The release hook is movable between a locked position and a released position and has a slot having a first end and a second end. The slot is positioned a spaced distance from the axis about which the release hook is pivotally mounted. The handle mechanism has a rotation stop that is positioned within the slot of the release hook and that is movable between the first and second ends of the slot. The handle mechanism is movable between a first position where the rotation stop is positioned at the first end of the slot, a second position where the rotation stop is positioned at the second end of the slot, and a third position where the handle mechanism is rotated from its second position while the rotation stop is positioned at the second end of the slot so that the rotation stop urges the release hook from its locked position to its released position.

According to yet another aspect of the present invention, a secondary latch assembly comprises, in combination, a mounting bracket, a release hook pivotally mounted to the mounting bracket about a first axis, and a handle mechanism. The release hook is movable between a locked position and a released position and has a slot having a first end and a second end. The handle mechanism comprises a striker plate pivotally mounted to the mounting bracket, a release handle, a connector mechanism that operatively interconnects the release handle and the striker plate, and a rotation stop attached to the striker plate. The release handle is pivotally mounted to the mounting bracket about a second axis a spaced distance from the first axis. The second axis is parallel to the first axis. The rotation stop is positioned within the slot of the release hook and is movable between the first and second ends of the slot. The handle mechanism is movable between a first position where the rotation stop is positioned at the first end of the slot, a second position where the rotation stop is positioned at the second end of the slot, and a third position wherein the handle mechanism is rotated from its second position while the rotation stop is positioned at the second end of the slot so that the rotation stop urges the release hook from its locked position to its released position.

According to yet a further aspect of the present invention, a secondary latch assembly comprises, in combination a mounting bracket, a release hook pivotally mounted to the mounting bracket about an axis, and a release handle. The release handle is pivotally mounted to the mounting bracket about the axis. The release hook movable between a locked position and a released position and has a slot having a first end and a second end. The handle has a rotation stop that is positioned within the slot of the release hook. The rotation stop is movable between the first and second ends of the slot. The handle is movable between a first position where the rotation stop is positioned at the first end of the slot, a second position where the rotation stop is positioned at the second end of the slot, and a third position wherein the handle is rotated from its second position while the rotation stop is positioned at the second end of the slot so that the rotation stop urges the release hook from its locked position to its released position.

From the foregoing disclosure and the following more detailed description of various preferred embodiments it will be apparent to those skilled in the art that the present invention provides a significant advance in the technology and art of secondary latch assemblies. Particularly significant in this regard is the potential the invention affords for providing a secondary latch assembly that is self-presenting, that is compact, that may be mounted to the hood of a vehicle so as to save space within the engine area, that may be mounted as a whole assembly so that installation is simplified, and that utilizes few parts so that manufacture is simplified and production costs are decreased. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
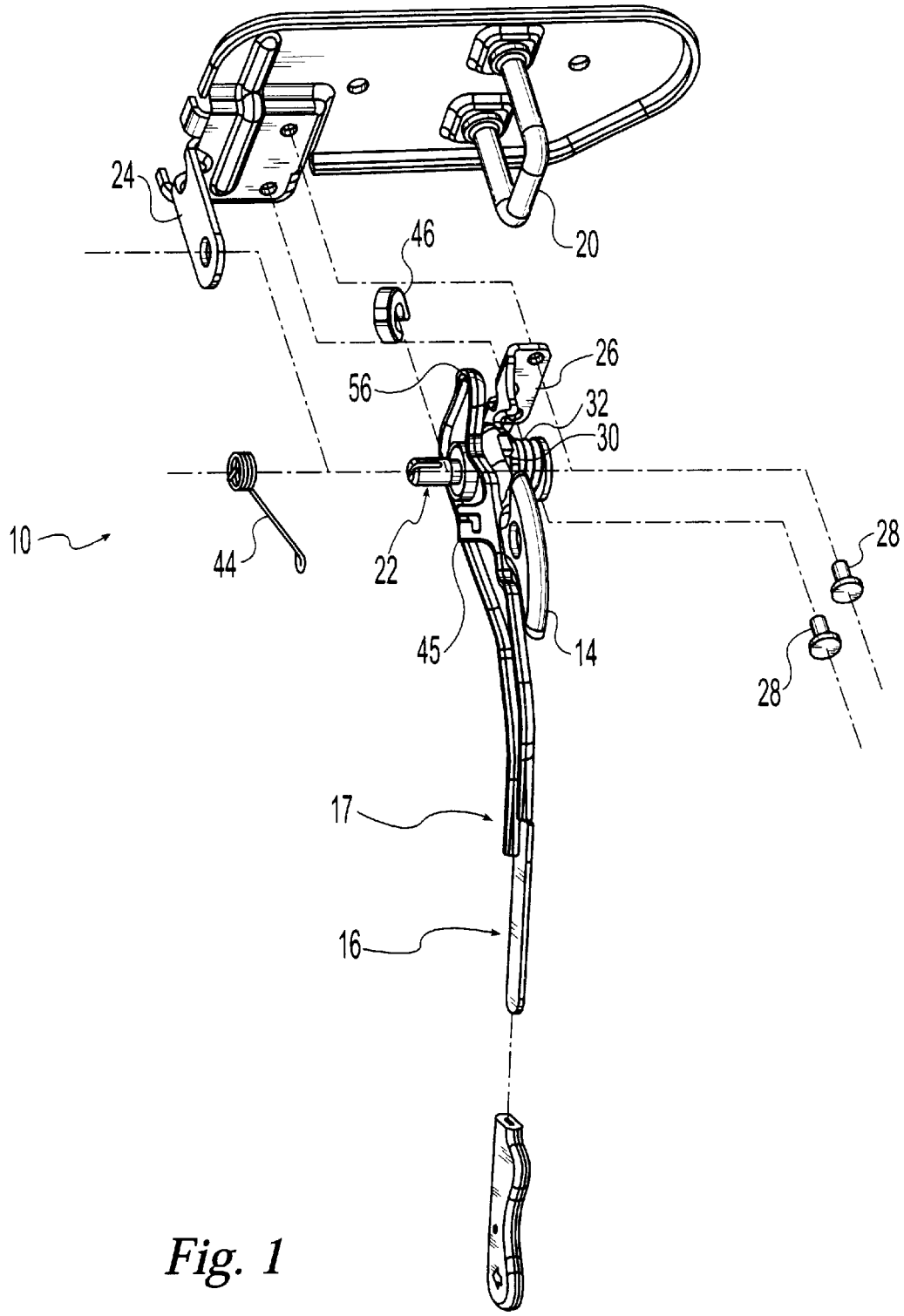
FIG. 1 is an exploded perspective view of a secondary latch assembly according to a preferred embodiment of the present invention.

It should be understood that the appended drawings are not necessarily to scale, presenting a somewhat simplified representation of various preferred features illustrative of the basic principles of the invention. The specific design features of the secondary latch assembly as disclosed herein, including, for example, specific dimensions, orientations, and shapes of the handle mechanism and release hook will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the secondary latch assembly illustrated in the drawings. In general, up or upward refers to in an upward direction in the plane of the paper in FIGS. 4–12 and down or downward refers to a downward direction in the plane of the paper in FIGS. 4–12.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved secondary latch assembly disclosed herein. The following detailed discussion of various alternative and preferred embodiments will illustrate the general principles of the invention with reference to a secondary hood latch assembly for use with a motor vehicle. Other embodiments suitable for other applications will be readily apparent to those skilled in the art given the benefit of this disclosure.

Referring now to the drawings, FIGS. 1–12 show a secondary hood latch assembly 10 for a motor vehicle, such as an automobile, according to the present invention. The illustrated embodiments of the present invention are particularly adapted for use with an automobile hood that is hinged for movement between a fully closed position and a fully opened position and is biased to move toward the fully opened position. In the preferred embodiments, the secondary latch assembly 10 is adapted to maintain the hood in a partially opened position after a primary latch releases the hood from the fully closed position. It is noted that the present invention can be utilized with any apparatus or system having a panel portion hinged for movement with respect to an enclosure portion and having and a primary and secondary latch for opening the panel portion.

As illustrated, the preferred embodiments of the secondary hood latch assembly 10 include a mounting bracket 12, a release hook 14, a handle mechanism 17, and rotation means 18. The mounting bracket 12 is used to mount the assembly 10 to the underside of a hood (not shown). The mounting bracket 12 preferably includes a striker 20 for use with a primary hood latch 60 (shown in FIGS. 8–12) for maintaining the hood in a closed position. When the primary latch releases the striker 20, the secondary hood latch assembly 10 engages a striker 21 (shown in FIGS. 4–12) to limit the upward movement of the hood until the release hook 14 is caused to release the striker 21, as more fully described below.

Figure 4:
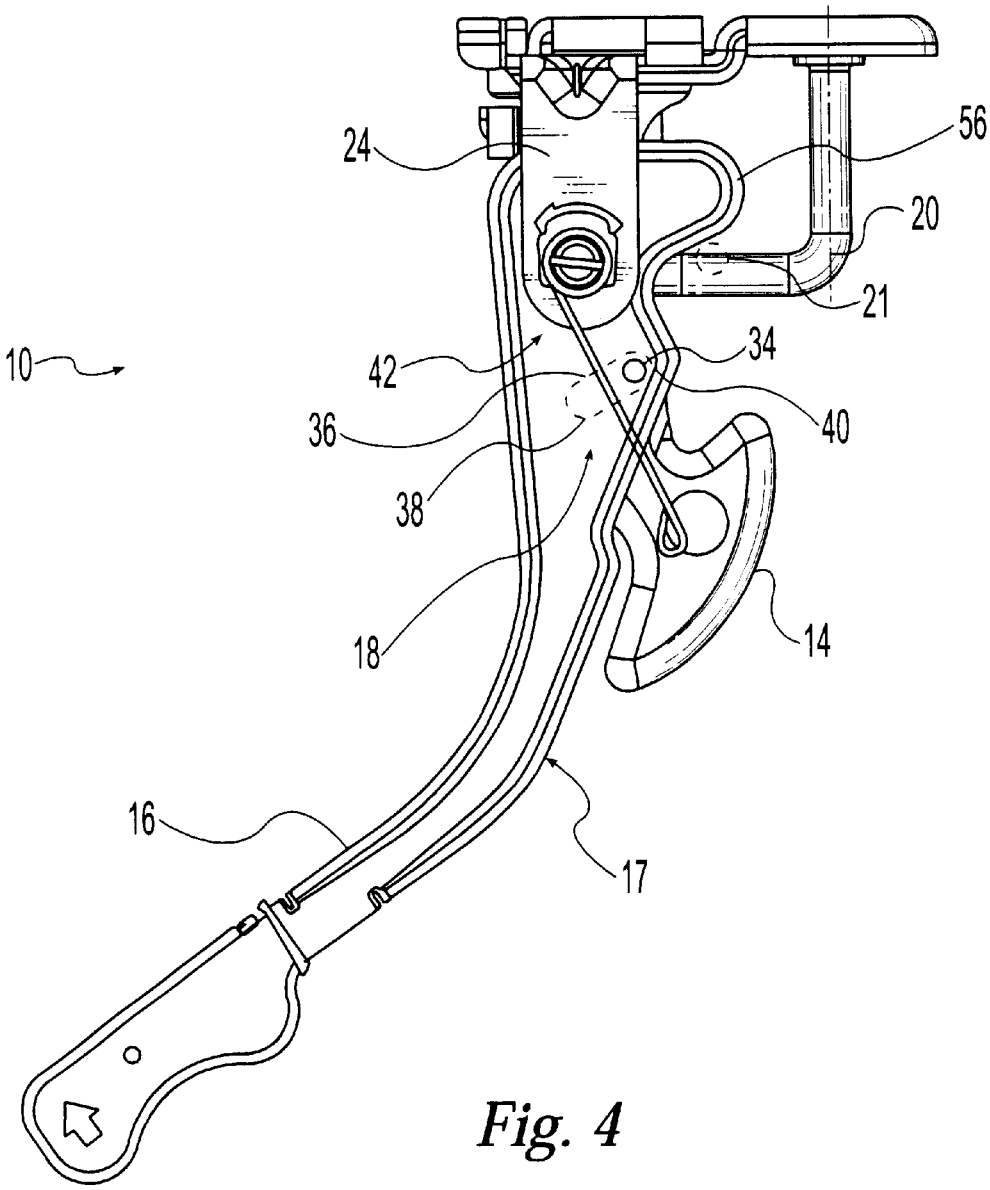
FIG. 4 is a side plan view of the secondary latch assembly of FIG. 2 showing the release handle is in a closed position.
Figure 5:
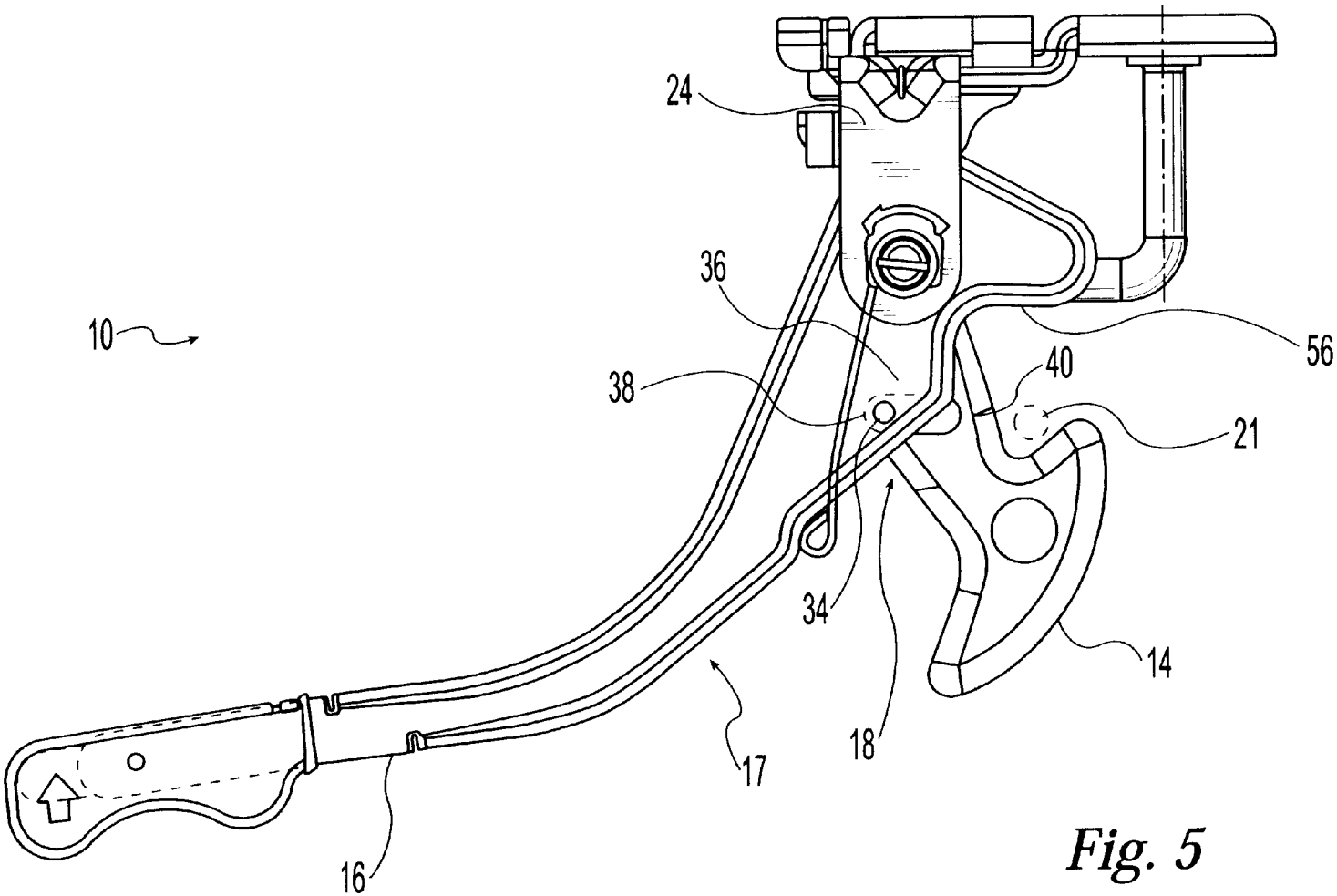
FIG. 5 is a side plan view of the secondary latch assembly of FIG. 2 showing the release handle is in a presented position.
Figure 6:
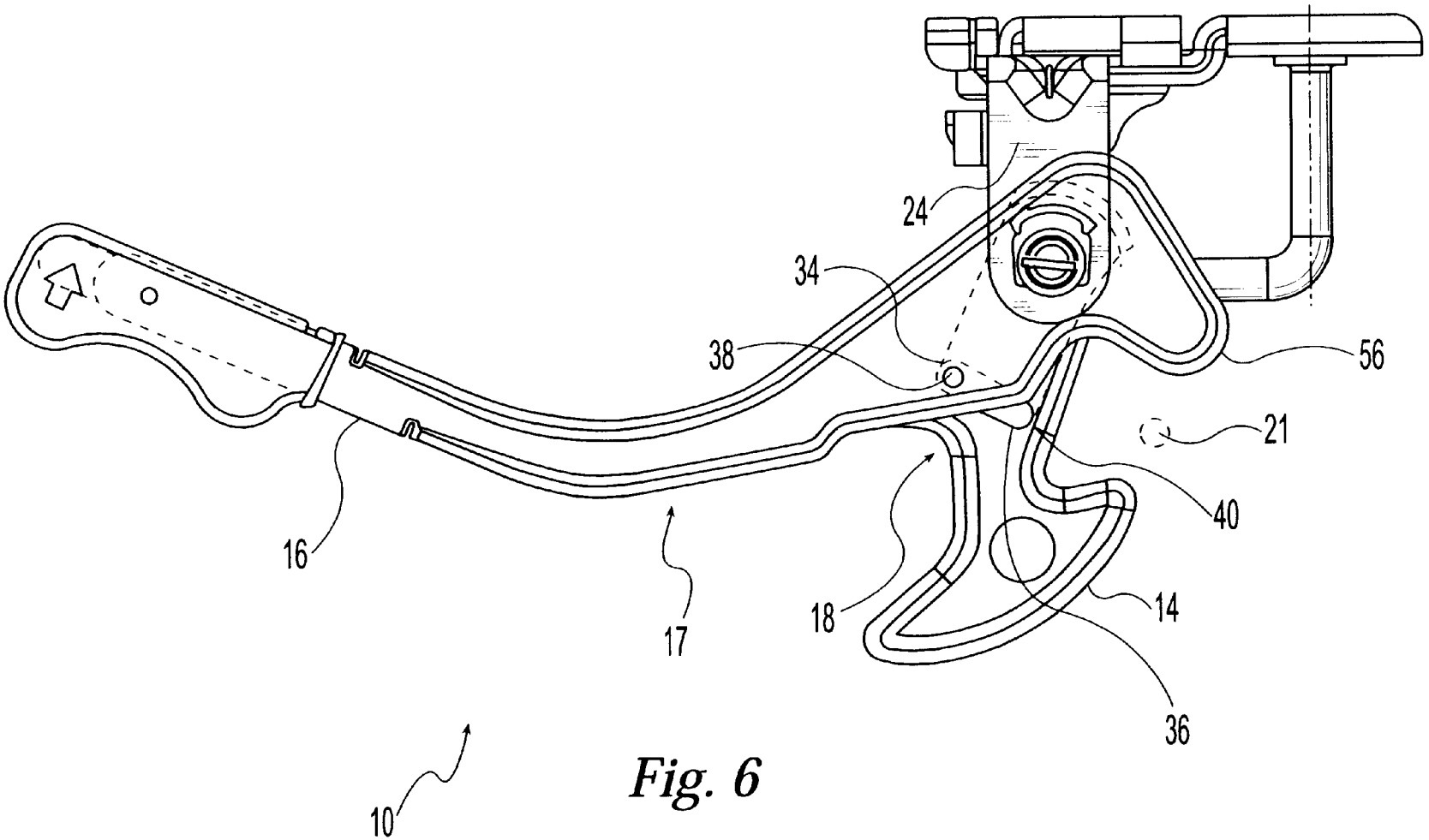
FIG. 6 is a side plan view of the secondary latch assembly of FIG. 2 showing the release handle is in a released position.
Figure 7:
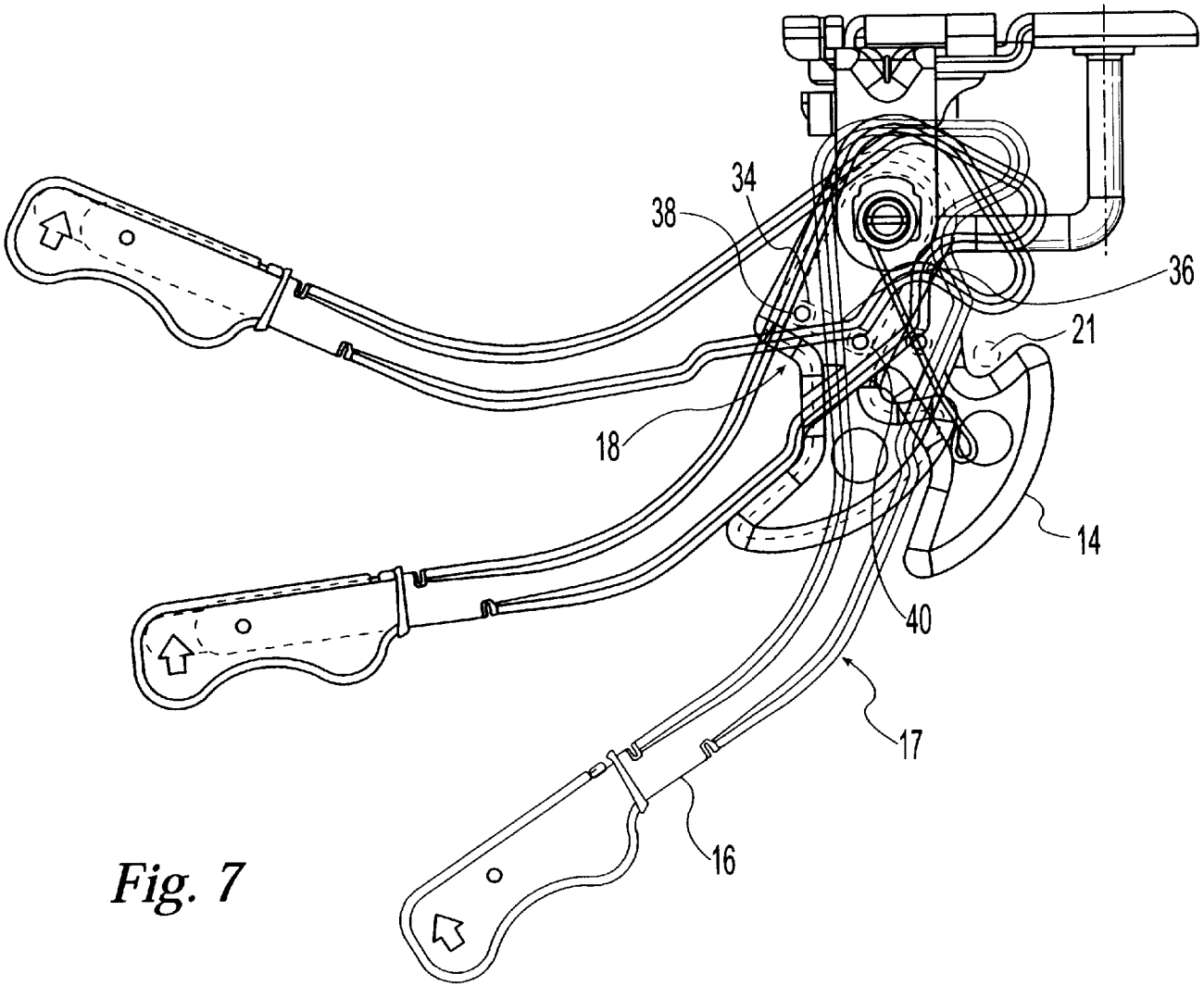
FIG. 7 is a side plan view of the secondary latch assembly of FIGS. 4, 5, and 6 showing the full range of motion of the release handle and the release hook.

In one preferred embodiment illustrated in FIGS. 1–7, the release hook 14 and the handle mechanism 17 are pivotally mounted to the mounting bracket 12 about a common rotational axis using a pivot pin 22. The release hook 14 is movable between (1) a locked position, as shown in FIGS. 4 and 5, where the release hook 14 will engage the striker 21 when the hood is in a partially opened position and (2) a released position, as shown in FIG. 6, allowing the hood to be fully opened. The handle mechanism 17 preferably comprises a release handle 16 and is preferably movable between (1) a first or closed position, as shown in FIG. 4, where the release handle 16 is retracted; (2) a second or presented position, as shown in FIG. 5, where the release handle 16 is presented to a user when the hood is held in a partially opened position; and (3) a third or released position, as shown in FIG. 6, that causes the release hook 14 to move to its released position allowing the hood to be fully opened. When the release handle 16 is in its closed position, the release handle 16 may be retracted within the enclosure portion of the vehicle (not shown). When the release handle 16 is in its presented position, the release handle 16 is positioned between the hood and the enclosure portion of the vehicle so that the release handle 16 is visible to a user in front of the hood. Although the release handle 16 is illustrated as being attached to the pivot pin 22, it is noted that the release handle 16 may be remotely positioned from the mounting bracket 12. It is also noted that the present invention may be used without a mounting bracket 12 by mounting the assembly 10 directly to a structure such as an automobile hood.

Figure 2:
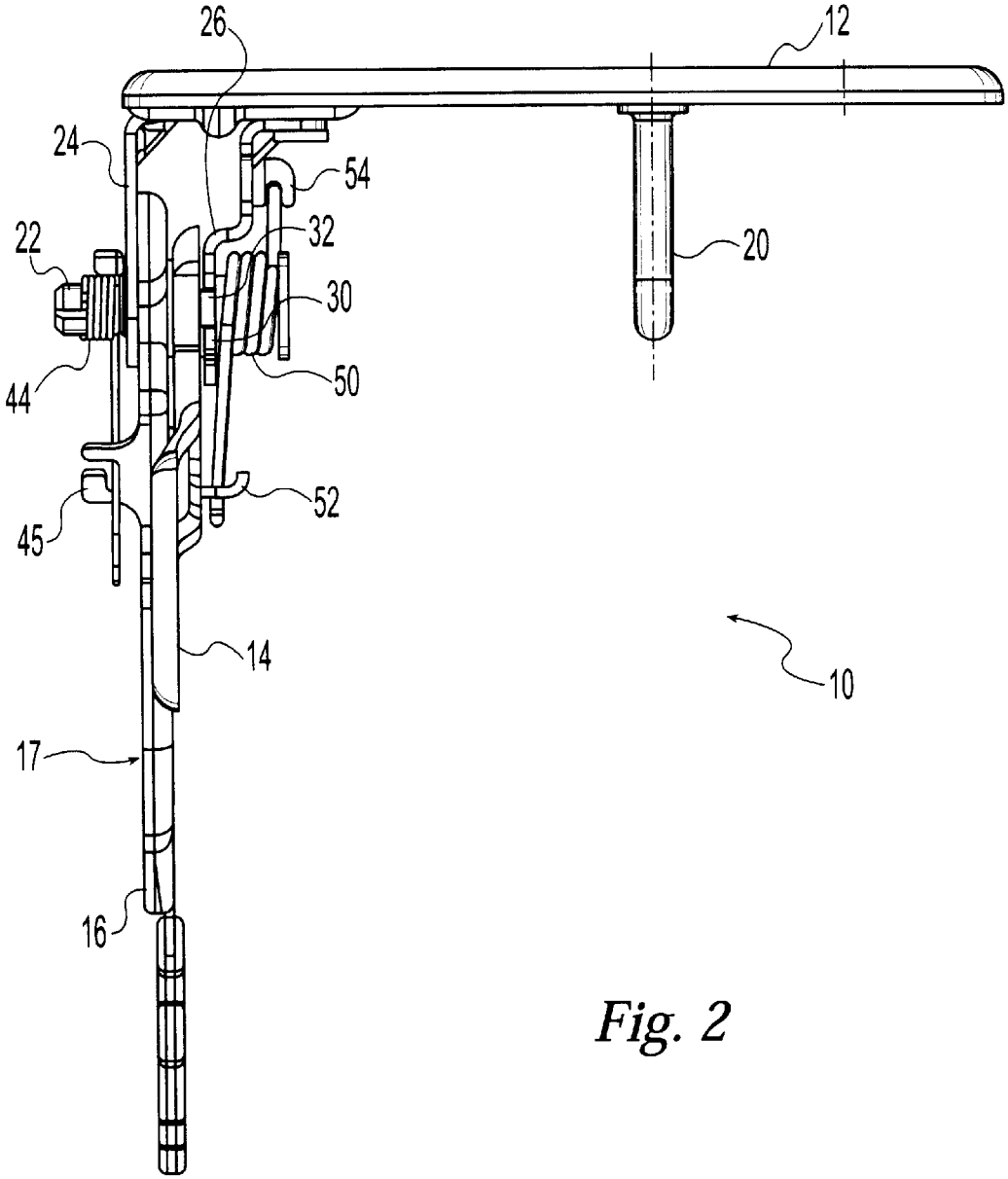
FIG. 2 is a rear plan view of the secondary latch assembly of FIG. 1.
Figure 3:
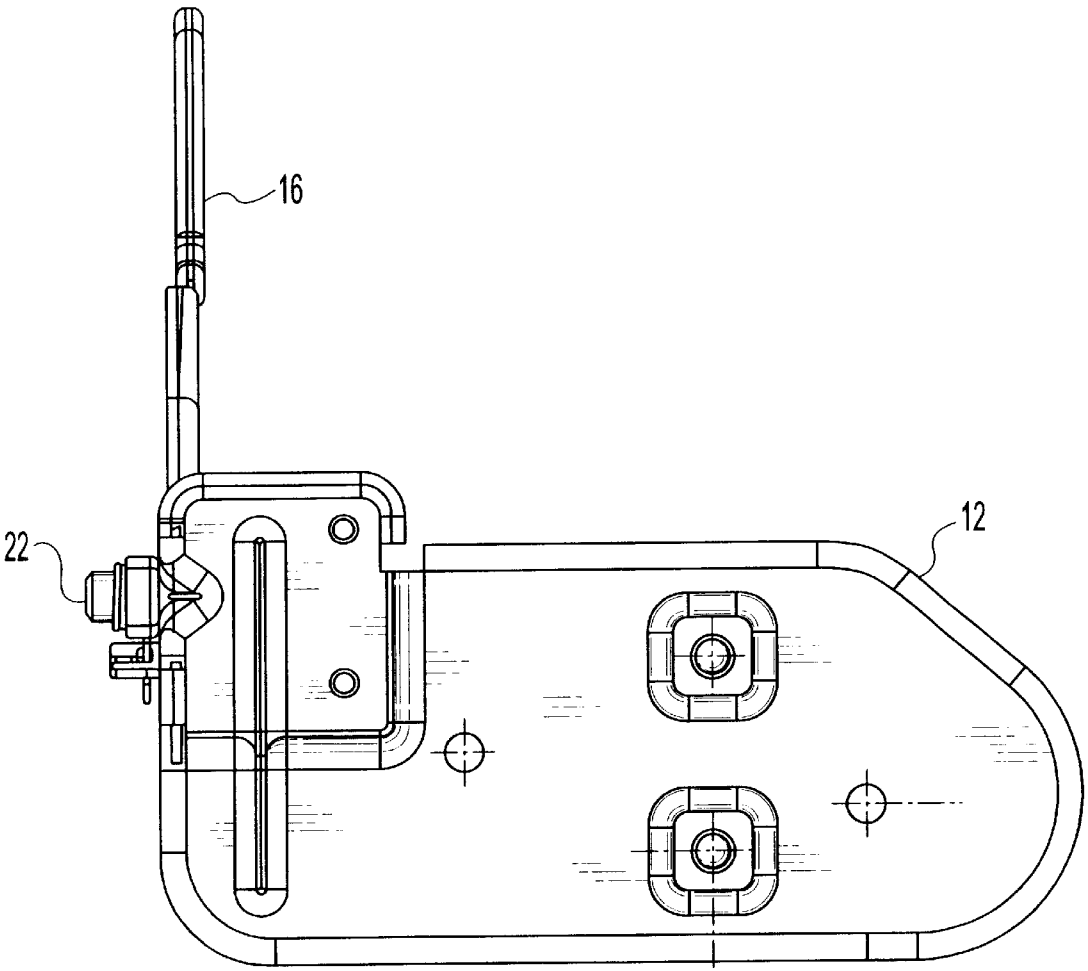
FIG. 3 is a top plan view of the secondary latch assembly of FIGS. 1 and 2.

As best illustrated in FIGS. 1 and 2, the mounting bracket 12 preferably includes a first pivot pin mounting portion 24 and a second pivot pin mounting portion 26 for mounting the pivot pin 22. The second pivot pin mounting portion 26 is preferably attached to the mounting bracket 12 with two mounting pins or rivets 28 (shown in FIG. 1). The second pivot pin mounting portion 26 also includes a slot 30 for accepting a flange 32 on the release hook 14 for limiting the rotational movement of the release hook 14. When the release hook 14 is in its locked position, the flange 32 contacts one end of the slot 30, and when the release hook 14 is in its released position, the flange 32 contacts-the-other end of the slot 30.

In the preferred embodiment, and as best illustrated in FIGS. 4–7, the secondary hood latch assembly 10 includes rotation means 18 for controlling the rotation of the release hook 14 and the rotation of the handle mechanism 17. The rotation means 18 allow the release handle 16 to move between its closed position and its presented position while the release hook 14 is maintained in its locked position. The rotation means 18 further allow the release handle 16 to rotate the release hook 14 to its released position as the release handle 16 rotates to its released position. The rotation means 18 include a rotation stop 34 that is positioned in a slot 36 in the release hook 14. Preferably, the slot 36 is positioned a spaced distance from the axis about which the release hook 14 is pivotally mounted. The slot 36 is preferably arcuate in shape, but other shapes of slots will be readily apparent to those skilled in the art given the benefit of this disclosure. The rotation stop 34 is connected to the release handle 16 so that the rotation stop 34 moves as the release handle 16 rotates. The rotation stop 34 moves between a first end 40 and a second end 38 of the slot 36 without affecting the position of the release hook 14. When the release handle 16 rotates while the rotation stop 34 is contacting the second end 38 of the slot 36, the rotation stop 34 urges the release hook 14 toward its released position. As illustrated in FIG. 4, the rotation stop 34 is positioned at the first end 40 of the slot 36 when the release handle 16 is in its closed position. As illustrated in FIG. 5, the rotation stop 34 is positioned at the second end 38 of the slot 36 when the release handle 16 is in its presented position. As illustrated in FIG. 6, the release handle 16 enters its released position by rotating while the rotation stop 34 is positioned in the second end 38 of the slot 36 so that the release hook 14 is forced to move from its locked position to its released position.

As best illustrated in FIGS. 1 and 2, the assembly 10 preferably includes a first biasing means for biasing the release handle 16 in its presented position. As shown in the illustrations, the biasing means may comprise, for example, a spring 44 attached to the pivot pin 22 with a first end fixedly attached to the pivot pin 22 and a second end connected to a slotted flange 45 on the release handle 16. The spring 44 biases the release handle 16 toward its presented position where the rotation stop 34 contacts the second end 38 of the slot 36. A clip 46 may also be used to separate the spring 44 from the mounting bracket 12. As more fully described below, the first biasing means present the handle 16 to a user when the primary hood latch is released so that the secondary latch assembly 10 is self-presenting.

As best illustrated in FIG. 2, the assembly 10 preferably includes a second biasing means for biasing the release hook 14 in its locked position. The second biasing means may comprise, for example, a spring 50 attached to the pivot pin 22 with one end connected to a second slotted flange 52 on the release hook 14 and a second end connected to a third slotted flange 54 on the second pivot pin mounting portion 26 of the mounting bracket 12. In the preferred embodiment, the second biasing means biasing the release hook 14 opposes, and creates a much stronger force than, the force created by the first biasing means biasing the rotation stop 34 against the second end 38 of the slot 36. In this manner, the release hook 14 will remain in the locked position even when the first biasing means are biasing the rotation stop 34 against the second end 38 of the slot 36 to present the release handle 16.

As best illustrated in FIGS. 4–7, the handle mechanism 17 also includes a striker plate 56 that is connected with the release handle 16 so that rotation of the release handle 16 will rotate the striker plate 56 and rotation of the striker plate 56 will rotate the release handle 16. The striker plate 56 is used to position the release handle 16 in its closed position when the hood is latched by the primary hood latch. As best illustrated in FIG. 4, when the hood is placed in the fully closed position, the striker 21 for the secondary latch assembly 10 contacts the striker plate 56 and forces the striker plate 56 to rotate. The rotation of the striker plate 56 rotates the rotation stop 34 to the first end 40 of the slot 36 and rotates the release handle 16 to its closed position.

Referring now to FIGS. 8–12, an alternative preferred embodiment is illustrated. Parts analogous to those in the first preferred embodiment illustrated in FIGS. 1–7 are indicated by the same numerals. In the alternative preferred embodiment, the handle mechanism 17 includes a release handle 16, a connector mechanism 58, and a striker plate 56. The striker plate 56 is pivotally mounted to the pivot pin 22 about a first rotational axis. The release handle 16 is pivotally mounted to the mounting bracket 12 about a second rotational axis at a position that is remote from pivot pin 22. The connector mechanism 58 operatively connects the release handle 16 to striker plate 56. The rotation stop 34 is attached to the striker plate 56. The connector mechanism 58 advantageously permits the handle 16 to be located remote from the striker plate 56 and the rotation stop 34, thereby providing greater flexibility in packaging of the secondary hood latch assembly 10. In the alternative preferred embodiment, the release hook 14 and the striker plate 56 are coaxial and the first and second rotational axes are parallel.

Figure 8:
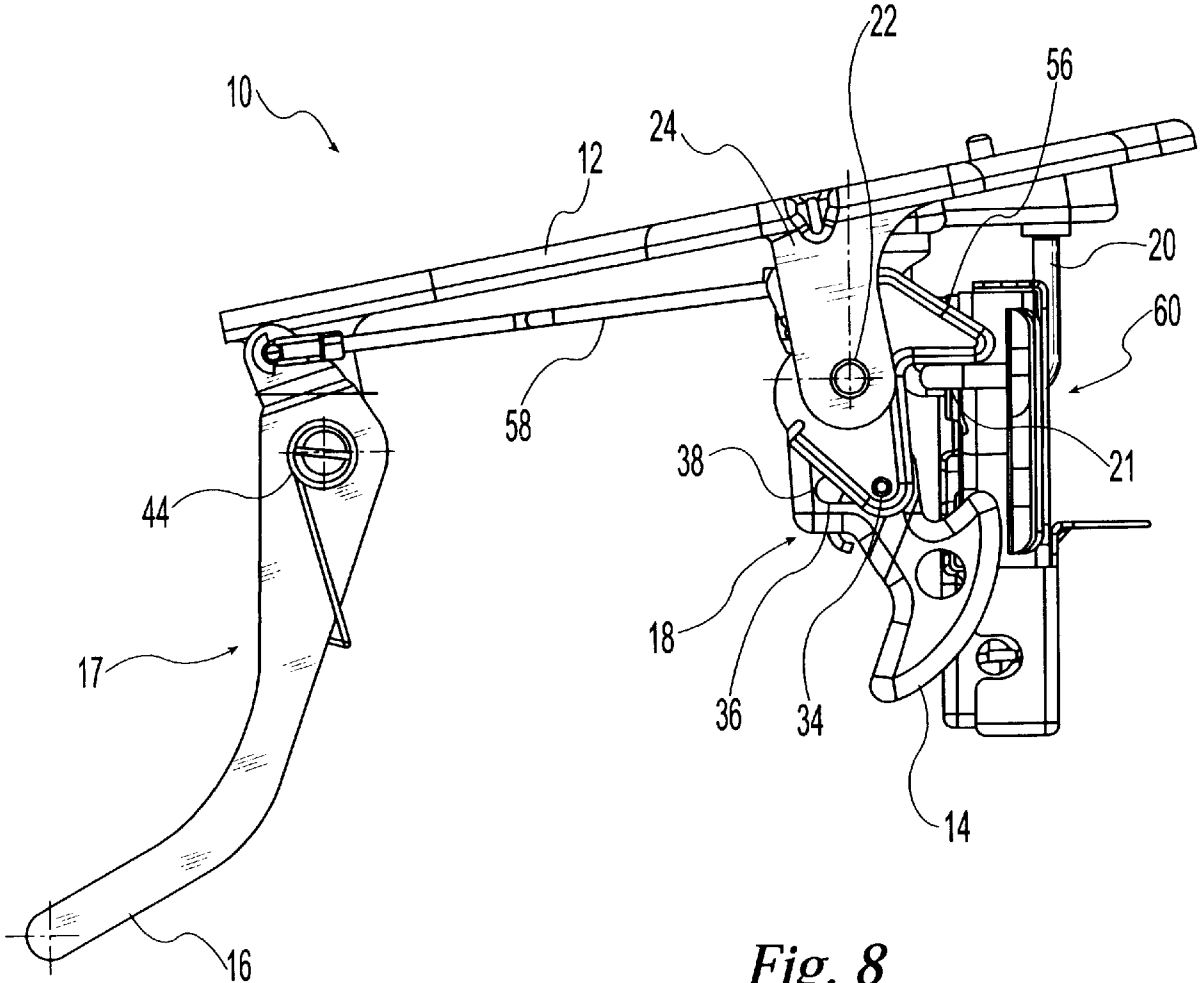
FIG. 8 is a side plan view of a secondary latch assembly according to an alternative preferred embodiment of the present invention showing the assembly when the hood of the vehicle is closed.

Referring to FIGS. 8–12, the alternative preferred embodiment will be used to describe the operation of the secondary hood latch assembly 10 in connection with the opening of a hood of an automobile having a primary hood latch 60. In FIG. 8, the hood (not shown) is in a fully closed position and the striker 20 attached to the mounting bracket 12 is latched within the primary hood latch 60. A striker 21 is contacting the striker plate 56 and maintaining the release handle 16 in its closed position within the hood. The release hook 14 is maintained in its locked position by spring 50 (not shown).

Figure 9:
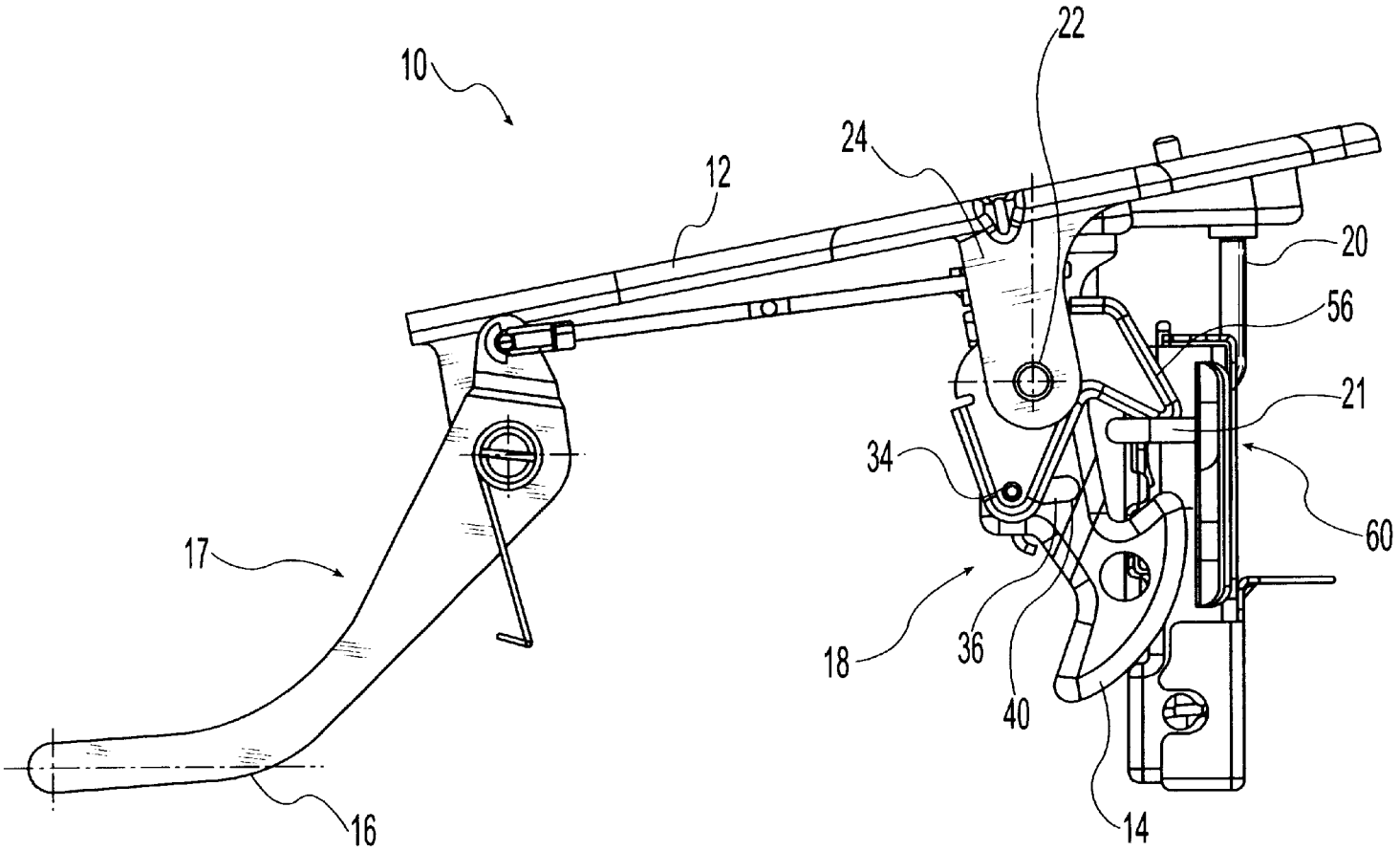
FIG. 9 is a side plan view of a secondary latch assembly of FIG. 8 showing the assembly when the primary latch has been released.

In FIG. 9, the primary hood latch 60 has released the striker 20 on the mounting bracket 12 and the hood has risen to a point where the striker 21 has disengaged the striker plate 56. Spring 44 (not shown) has rotated the release handle 16 to its presented position and rotated the rotation stop 34 to the second end 38 of the slot 36. The release hook 14 is maintained in its locked position by spring 50 (not shown).

Figure 10:
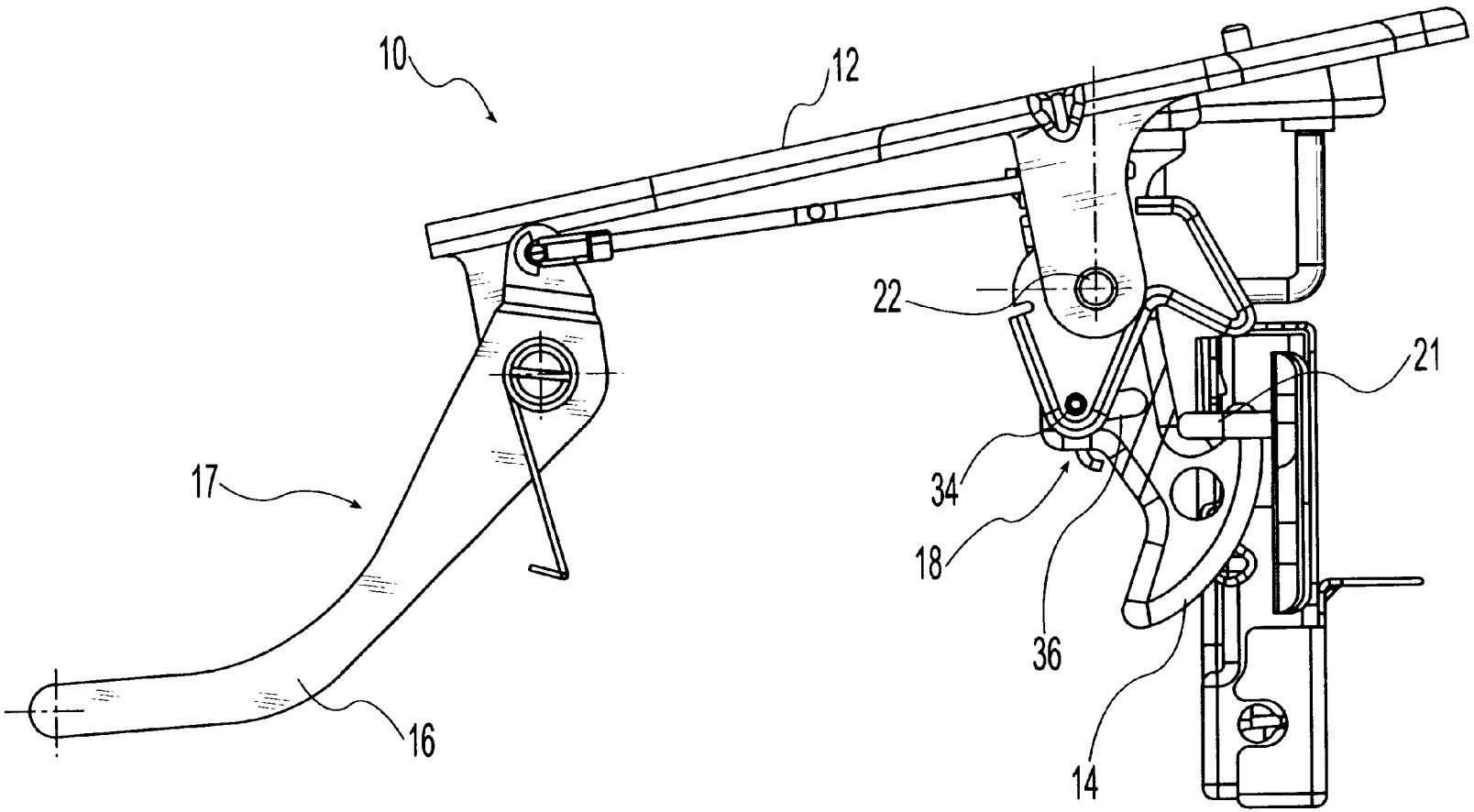
FIG. 10 is a side plan view of a secondary latch assembly of FIG. 8 showing the assembly when the assembly has been engaged by a striker.

In FIG. 10, the hood has risen to a point where the striker 21 has engaged the release hook 14. In this position, the assembly 10 limits any further upward movement of the hood toward its opened position. The release handle 16 remains biased in its presented position and the release hook 14 remains in its locked position engaged with the striker 21. In this position, the release handle 16 is presented to a user and is visible from the outside of the hood enclosure.

Figure 11:
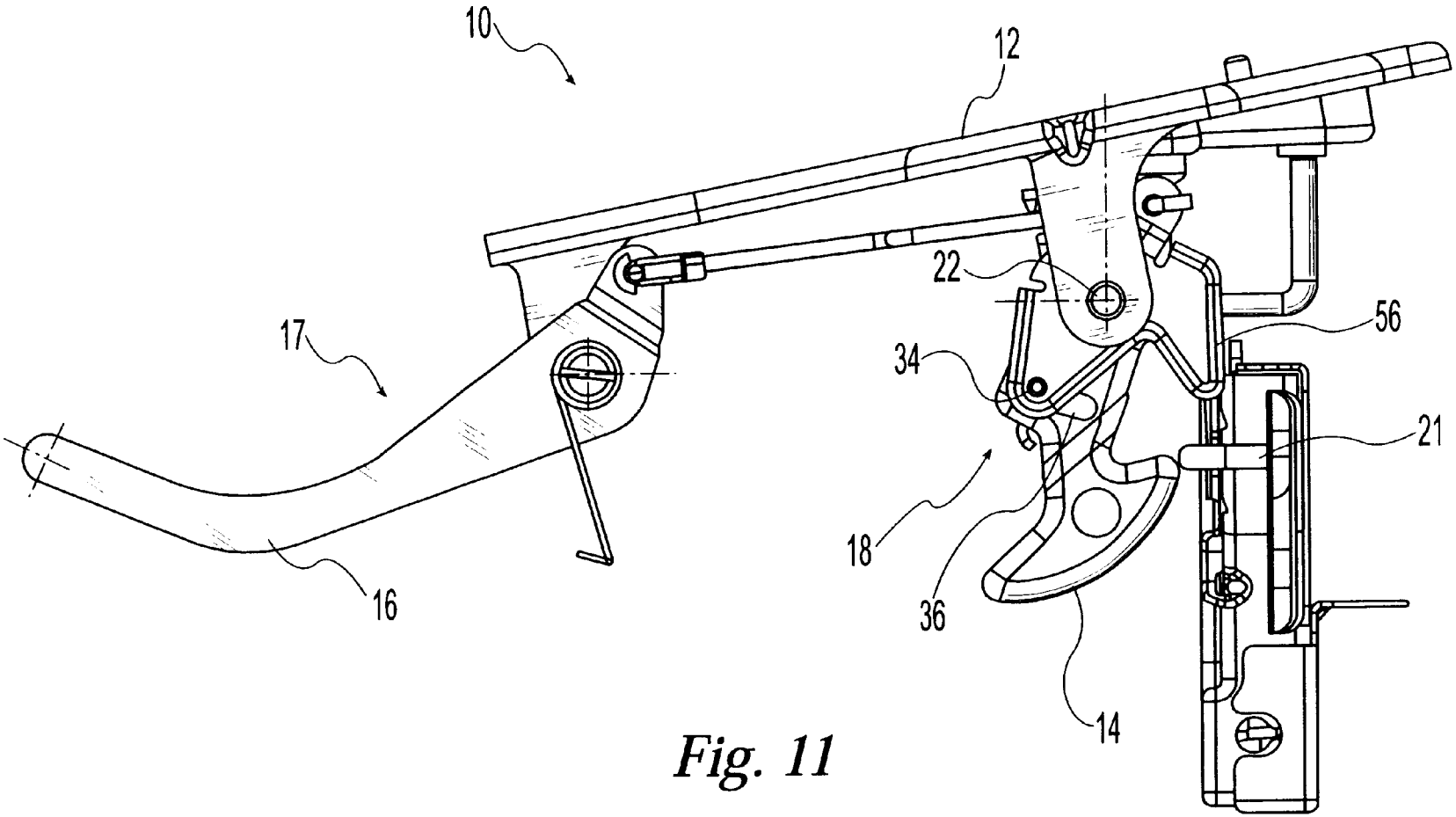
FIG. 11 is a side plan view of a secondary latch assembly of FIG. 8 showing the assembly when the release hook has been released from the striker.

In FIG. 11, the release handle 16 has been moved to its released position. Rotation of the release handle 16 has rotated the rotation stop 34 while it is in contact with the second end 38 of the slot 36 to urge the release hook 14 to its released position and disengage the striker 21.

Figure 12:
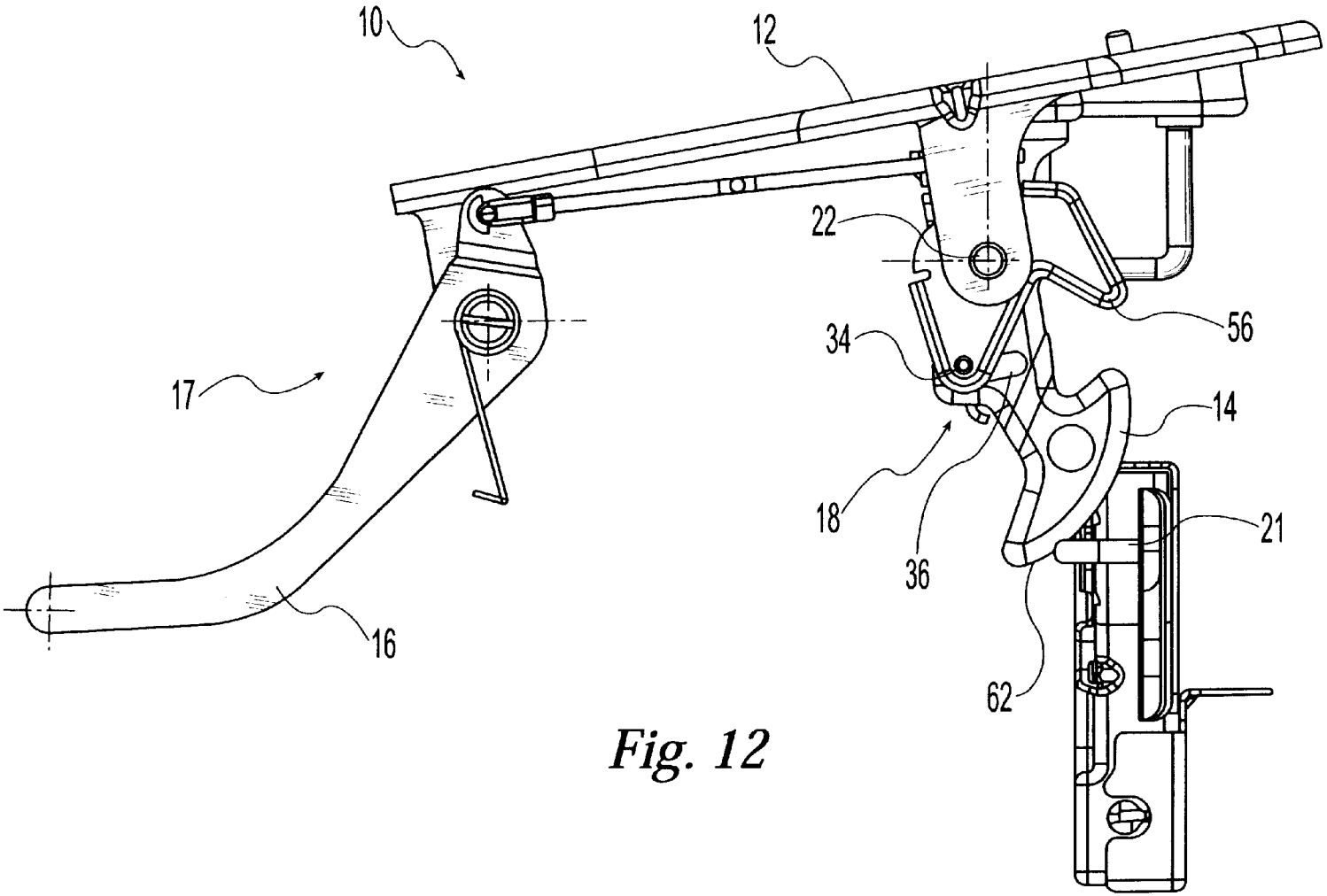
FIG. 12 is a side plan view of a secondary latch assembly of FIG. 8 showing the assembly when the release hook has moved above the striker.

In FIG. 12, the hood has risen to a point where the release hook 14 is above the striker 21. In this position, the hood is free to move to its fully opened position. The release hook 14 has returned to its locked position due to spring 50 (not shown) and the release handle 16 is maintained in its presented position due to spring 44 (not shown).

When the hood is moved from its fully opened position toward its fully closed position, the curved bottom surface 62 of the release hook 14 contacts the striker 21 at the position shown in FIG. 12. As the hood is moved downward, the striker 21 forces the release hook 14 to pivot from its locked position to its released position. The curved bottom surface 62 slides along the striker 21 as the release hook 14 pivots from its locked position to its released position. Once the release hook 14 has moved to a point below the striker 21, the spring 50 biases the release hook 14 back to its locked position. When the hood moves further downward toward its closed position, the primary hood latch 60 engages and latches the striker 20 on the mounting bracket 12. The striker 21 contacts the striker plate 56 and forces the rotation stop 34 to rotate to the first end 40 in the slot 36 and the release handle 16 to pivot to its closed position, as illustrated in FIG. 8.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the handle mechanism and release hook may have various shapes and positions. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A secondary latch assembly comprising, in combination:

a mounting bracket;

a release hook pivotally mounted to the mounting bracket, the release hook movable between a locked position and a released position and having a slot provided with a first end and a second end;

a first spring biasing the release hook towards the locked position;

a handle mechanism pivotally mounted to the mounting bracket, the handle mechanism having a rotation stop, the rotation stop being positioned within the slot of the release hook and being movable between the first and second ends of the slot, the handle mechanism movable between a first position where the rotation stop is positioned at the first end of the slot while the first spring holds the release hook in the locked position, a second position where the rotation stop is positioned at and engaging the second end of the slot while the first spring holds the release hook in the locked position, and a third position where the rotation stop is positioned at and engaging the second end of the slot and holds the release hook in the released position against the bias of the first spring; and a second spring biasing the rotation stop towards and into engagement with the second end of the slot;

wherein the pivot stop moves the release hook from the locked position to the released position against the bias of the first spring when the handle mechanism moves from the second position to the third position.

2. The secondary latch assembly of claim 1 wherein the handle mechanism comprises:

a release handle pivotally mounted to the mounting bracket; and a striker plate connected to the release handle;

wherein the striker plate includes a cam surface to move the handle mechanism from the second position to the first position against the bias of the second spring.

3. The secondary latch assembly of claim 1 wherein the handle mechanism comprises:

a striker plate pivotally mounted to the mounting bracket;

a release handle pivotally mounted to the mounting bracket remote from the striker plate; and a connector mechanism operatively interconnecting the striker plate and the release handle;

wherein the rotation stop is attached to the striker plate;

wherein the striker plate includes a cam surface to move the handle mechanism from the second position to the first position against the bias of the second spring.

4. The secondary latch assembly of claim 1 wherein the second spring biases the handle mechanism from the first position towards the second position and from the second position towards the third position and the first spring biases the handle mechanism from the third position towards the second position.

5. The secondary latch assembly of claim 4 wherein the first spring provides a larger force than the second spring.

6. The secondary latch assembly of claim 1 wherein the release hook and the handle mechanism are pivotally mounted to the mounting bracket about a common pivot axis.

7. A secondary latch assembly comprising, in combination:

a mounting bracket;

a release hook pivotally mounted to the mounting bracket about an axis, the release hook movable between a locked position and a released position and having an arched slot positioned a spaced distance from the axis and concentric with the axis, the slot having a first end and a second end;

a handle mechanism pivotally mounted to the mounting bracket about the axis, the handle mechanism having a rotation stop, the rotation stop being positioned within the slot of the release hook and being movable between the first and second ends of the slot, the handle mechanism movable between a first position where the rotation stop is positioned at the first end of the slot with the release hook in the locked position, a second position where the rotation stop is positioned at the second end of the slot with the release hook in the locked position, and a third position where the rotation stop is positioned at and engaging the second end of the slot with the release hook in the released position;

a first spring biasing the release hook towards the locked position; and a second spring biasing the rotation stop towards the second end of the slot;

wherein the pivot stop moves the release hook from the locked position to the released position when the handle mechanism moves from the second position to the third position.

8. The secondary latch assembly of claim 7 wherein the handle mechanism comprises:

a release handle pivotally mounted to the mounting bracket; and a striker plate connected to the release handle;

wherein the striker plate includes a cam surface to move the handle mechanism from the second position to the first position against the bias of the second spring.

9. The secondary latch assembly of claim 7 wherein the handle mechanism comprises:

a striker plate pivotally mounted to the mounting bracket;

a release handle pivotally mounted to the mounting bracket remote from the striker plate; and a connector mechanism operatively interconnecting the striker plate and the release handle;

wherein the rotation stop is attached to the striker plate;

wherein the striker plate includes a cam surface to move the handle mechanism from the second position to the first position against the bias of the second spring.

10. The secondary latch assembly of claim 7 wherein the first spring holds the release hook in the locked position when the handle mechanism is in the first and second positions, the rotation stop is positioned at and engaging the second end of the slot and holds the release hook in the released position against the bias of the first spring when the handle mechanism is in the third position, and the pivot stop moves the release hook from the locked position to the released position against the bias of the first spring when the handle mechanism moves from the second position to the third position.

11. The secondary latch assembly of claim 7 wherein the second spring biases the handle mechanism from the first position towards the second position and from the second position towards the third position and the first spring biases the handle mechanism from the third position towards the second position.

12. The secondary latch assembly of claim 11 wherein the first spring provides a larger force than the second spring.

13. A secondary latch assembly comprising, in combination:

a mounting bracket;

a release hook pivotally mounted to the mounting bracket about a first axis, the release hook movable between a locked position and a released position and having a slot provided with a first end and a second end;

a first spring biasing the release hook towards the locked position;

a handle mechanism comprising;

a striker plate pivotally mounted to the mounting bracket;

a release handle pivotally mounted to the mounting bracket about a second axis a spaced distance from the first axis, the second axis being parallel to the first axis;

a connector mechanism operatively interconnecting the release handle and the striker plate; and a rotation stop attached to the striker plate, the rotation stop being positioned within the slot of the release hook and being movable between the first and second ends of the slot; and a second spring biasing the rotation stop towards the second end of the slot;

wherein the release handle is movable between a first position where the rotation stop is positioned at the first end of the slot with the release hook in the locked position, a second position where the rotation stop is positioned at the second end of the slot with the release hook in the locked position, and a third position where the rotation stop is positioned at and engaging the second end of the slot with the release hook in the released position;

wherein the pivot stop moves the release hook from the locked position to the released position against the bias of the first spring when the release handle moves from the second position to the third position.

14. The secondary latch assembly of claim 13 wherein the second spring biases the release handle from the first position towards the second position and from the second position towards the third position and the first spring biases the release handle from the third position towards the second position.

15. The secondary latch assembly of claim 14 wherein the first spring provides a larger force than the second spring.

16. The secondary latch assembly of claim 13 wherein the striker plate is pivotally mounted to the mounting bracket about the first axis.

17. The secondary latch assembly of claim 13 wherein the striker plate includes a cam surface which moves the release handle from the second position to the first position against the bias of the second spring.

18. A primary and secondary latch assembly comprising, in combination:

a mounting bracket;

a primary striker secured to the mounting bracket;

a primary latch operable to latch with the primary striker;

a secondary latch including:

a release hook pivotally mounted to the mounting bracket about an axis, the release hook movable between a locked position and a released position and having a slot provided with a first end and a second end; and a release handle pivotally mounted to the mounting bracket, the release handle a rotation stop, the rotation stop being positioned within the slot of the release hook and being movable between the first and second ends of the slot, the release handle movable between a first position where the rotation stop is positioned at the first end of the slot with the release hook in the locked position, a second position where the rotation stop is positioned at the second end of the slot with the release hook in the locked position, and a third position where the rotation stop is positioned at the second end of the slot with the release hook in the released position;

wherein the pivot stop moves the release hook from the locked position to the released position when the release handle moves from the second position to the third position.

19. The primary and secondary latch assembly of claim 18 further comprising a striker plate connected to the release handle, wherein the striker plate includes a cam surface which moves the release handle from the second position to the first position against the bias of the second spring.

20. The primary and secondary latch assembly of claim 18 further comprising a first spring biasing the release hook towards the locked position and a second spring biasing the rotation stop towards the second end of the slot.

21. The primary and secondary latch assembly of claim 20 wherein the rotation stop is positioned at and engaging the second end of the slot while the first spring holds the release hook in the locked position when the release handle is in the second position, and the rotation stop is positioned at and engaging the second end of the slot and holds the release hook in the released position against the bias of the first spring when the release handle is in the third position, and the pivot stop moves the release hook from the locked position to the released position against the bias of the first spring when the handle moves from the second position to the third position.

22. The primary and secondary latch assembly of claim 20 wherein the second spring biases the release handle from the first position towards the second position and from the second position towards the third position and the first spring biases the release handle from the third position towards the second position.

23. The primary and secondary latch assembly of claim 22 wherein the first spring provides a larger force than the second spring.

24. The primary and secondary latch assembly of claim 18 wherein the release handle is pivotally mounted to the mounting bracket about the axis which the release hook is pivotally mounted to the mounting bracket.

* * * * *